US006074042A

United States Patent [19]

Gasvoda et al.

[11] Patent Number: 6,074,042

[45] Date of Patent: Jun. 13, 2000

[54] INK CONTAINER HAVING A GUIDE FEATURE FOR INSURING RELIABLE FLUID, AIR AND ELECTRICAL CONNECTIONS TO A PRINTING SYSTEM

[75] Inventors: Eric L. Gasvoda, Salem; Susan M. Hmelar, Corvallis; David O. Merrill, Corvallis; Norman E. Pawlowski, Jr., Corvallis, all of Oreg.

[73] Assignee: Hewlett-Packard Company, Palo Alto, Calif.

[21] Appl. No.: 08/871,566

[22] Filed: Jun. 4, 1997

[51] Int. Cl.[7] ..... B41J 2/14

[52] U.S. Cl. ..... 347/50

[58] Field of Search ..... 347/84, 85, 86, 347/87, 50

[56] References Cited

U.S. PATENT DOCUMENTS

| | | | |
|---|---|---|---|
| 4,162,501 | 7/1979 | Mitchell et al. | 347/23 |
| 4,183,031 | 1/1980 | Kyser et al. | 347/23 |
| 4,253,103 | 2/1981 | Heinzl et al. | 347/23 |
| 4,475,116 | 10/1984 | Sicking et al. | 347/86 |
| 4,511,906 | 4/1985 | Hara | 347/86 |
| 4,568,954 | 2/1986 | Rosback | 347/23 |
| 4,604,633 | 8/1986 | Kimura et al. . | |
| 4,629,164 | 12/1986 | Sommerville | 239/69 |
| 4,737,801 | 4/1988 | Ichihashi et al. | 347/85 |
| 4,760,409 | 7/1988 | Kiyohara et al. . | |
| 4,831,389 | 5/1989 | Chan | 347/86 |
| 4,888,602 | 12/1989 | Watanabe et al. | 347/86 |
| 5,049,898 | 9/1991 | Arthur et al. | 347/19 |
| 5,137,379 | 8/1992 | Ukai et al. | 400/121 |
| 5,138,342 | 8/1992 | Kurata et al. | 400/175 |
| 5,245,361 | 9/1993 | Kashimura et al. | 347/50 |
| 5,365,312 | 11/1994 | Hillmann et al. | 355/206 |
| 5,506,611 | 4/1996 | Ujita et al. | 347/86 |
| 5,610,635 | 3/1997 | Murray et al. | 347/7 |

FOREIGN PATENT DOCUMENTS

| | | | |
|---|---|---|---|
| 0086 061 | 2/1982 | European Pat. Off. | 85/84 |
| 0440261A2 | 8/1991 | European Pat. Off. | B41J 2/175 |
| 0610965A1 | 8/1994 | European Pat. Off. | B41J 2/175 |
| 0739740A1 | 10/1996 | European Pat. Off. | B41J 2/175 |
| 0789322A2 | 8/1997 | European Pat. Off. | G06K 15/00 |
| 06064182 | 3/1994 | Japan | B41J 2/175 |

*Primary Examiner*—N. Le
*Assistant Examiner*—Thien Tran
*Attorney, Agent, or Firm*—Kevin B. Sullivan

[57] ABSTRACT

The present invention is a replaceable ink container for providing ink to an off-axis printing system. The printing system responsive to electrical signals from the replaceable ink container for controlling printer parameters. The ink container has a leading edge and a trailing edge relative to a direction of insertion of the ink container into the printing system. The replaceable ink container includes a fluid outlet disposed toward the leading edge. The fluid outlet is configured for fluid connection to a hollow needle associated with the printing system The hollow needle extends in a direction opposite the insertion direction. Included in the ink container is a plurality of electrical contacts disposed on the ink container. The plurality of electrical contacts are configured for engagement with complementary electrical contacts associated with the printing system Also included in the ink container is a guide member extending from the ink container along the insertion direction. The guide member is configured for engaging a tapered guide member receiving slot associated with the printing system. This engaging repositions the complementary electrical contacts relative to the hollow needle to ensure proper alignment of complementary electrical contacts with the plurality of electrical contacts during insertion of the ink container into the printing system

16 Claims, 12 Drawing Sheets

SECTION 6 - 6′

SECTION 7 - 7'

INK CONTAINER HAVING A GUIDE FEATURE FOR INSURING RELIABLE FLUID, AIR AND ELECTRICAL CONNECTIONS TO A PRINTING SYSTEM

CROSS-REFERENCES TO RELATED APPLICATIONS

This application is related commonly assigned co-pending patent application, Ser. No. 08/869,038, filed herewith, entitled "*Electrical Interconnect for a Replaceable Ink Container*" incorporated herein by reference, and is related to commonly assigned co-pending patent application, Ser. No. 08/869,150, filed herewith, entitled "*Method and Apparatus for Securing an Ink Container*" incorporated herein by reference, and is related to commonly assigned co-pending patent application, Ser. No. 08/869,240, filed herewith, entitled "*Ink Container with an Inductive Ink Level Sense*" incorporated herein by reference, and is related to commonly assigned co-pending patent application, Ser. No. 08/869,122, filed herewith, entitled "Ink Level Estimation Using Drop Count and Ink Level Sense" incorporated herein by reference, and is related to commonly assigned co-pending patent application, Ser. No. 08/868,773, filed herewith, entitled "*Ink Container Providing Pressurized Ink with Ink Level Sensor*" incorporated herein by reference and is related to commonly assigned co-pending patent application, Ser. No. 08/868,927, filed herewith, entitled "*An Ink Container Having a Multiple Functioned Chassis*" incorporated herein by reference and is related to commonly assigned co-pending patent application, Ser. No. 08/869,023, filed herewith, entitled "*High Performance Ink Container with Efficient Construction*" incorporated herein by reference.

BACKGROUND OF THE INVENTION

The present invention relates to ink-jet printing systems, and more particularly, ink-jet printing systems which make use of ink containers that are replaceable separate from a printhead.

Ink-jet printers frequently make use of an ink-jet printhead mounted to a carriage which is moved back and fourth across a print media, such as paper. As the printhead is moved across the print media, a control system activates the printhead to deposit ink droplets onto the print media to form images and text.

Previously used printers have made use of an ink container that is separably replaceable from the printhead. When the ink cartridge is exhausted the ink cartridge is removed and replaced with a new ink container. The use of replaceable ink containers that are separate from the printhead allow users to replace the ink container without replacing the printhead. The printhead is then replaced at or near the end of printhead life and not when the ink container is exhausted.

Previously used off-axis ink delivery systems have made use of a memory device located in the ink container for altering the printhead drive conditions based on the information stored in the memory device. For example, U.S. Pat. 5,506,611 to Ujita et al discloses the use of a memory device having electric terminals for providing drive conditions to the printhead. These drive conditions include drive voltage, pulse width, frequency, and the number of preliminary discharges. The memory device is mounted to the outer surface of the ink cartridge so that electrical contacts for the memory device are spaced apart on the outer surface of the ink cartridge. As the ink cartridge is inserted into the ink-jet printer, electric terminals associated with the bubble-jet printer contact the electric terminals associated with the ink cartridge.

It is important that the ink container and printer form proper electrical connection to ensure proper printer operation. Proper electrical connection requires that each electrical contact associated with the ink container be electrically connected to a corresponding electrical contact associated with the printer portion. In addition, each of these electrical connections should be a reliable low resistance electrical connection.

One problem associated with the use of electrical contacts or terminals positioned on the outer portion of the ink cartridge is that these electrical contacts are subject to contamination. Contamination can result from the handling of the ink cartridge or ink spillage from the fluid interconnect. Contamination from handling includes hand oils and salts which are frequently present in human skin. This contamination may be transferred to the electrical contacts associated with the printer. One particular contamination problem is the combination of dust and hand oils. Contamination of the electrical contacts can result in unreliable electrical contact between the ink cartridge and the printer resulting in system reliability problems. Furthermore, the use of electrical contacts on the outer surface of the ink cartridge makes these terminals susceptible to liquid contamination such as moisture or spilled ink. Liquid contaminates can result in the shorting of these electrical contacts resulting in a faulty electrical interconnect and possibly system failure. Furthermore, inks used for ink-jet printing typically make use of solvents and surfactants which over time can result in corrosion of the electrical contacts preventing proper electrical contact between the printer and ink container.

Another problem associated with the use of electrical contacts or terminals positioned on the outer portion of the ink cartridge is that these contacts are subject to mechanical damage to the contacts such as scraping, denting or pealing, to name a few. This damage, if sufficient, may result in reliability problems or failure of the electrical interconnect between the printer and ink container.

Still another problem associated with the use of electrical terminals positioned on the outer portion of the ink cartridge is that these terminals subject the storage device to electrostatic discharge (ESD). Electrostatic discharge results from the electric terminals contacting a charged surface resulting in a discharge through the storage device. This discharge can result in catastrophic failure or reduce lifetime or reliability of the storage device. Storage devices such as CMOS semiconductor devices are particularly susceptible to electrostatic discharge damage.

There is an ever present need for printing systems which are capable of providing low operating costs such as printers which make use of off-axis type ink supplies. In addition, these printing systems should be easy to operate, such as, including some form of memory for storing printing parameters so that the user is not required to adjust printer parameters when the ink container is replaced. These ink supplies should be capable of reliable insertion into the printing system to ensure proper fluid interconnection and proper electrical interconnection with the printer is achieved. In addition, these interconnections should be reliable and should not degrade over time and use. For example, the fluid interconnect should not leak during use or over time and the electrical interconnect should be reliable during use and over time. In addition, these ink cartridges should not require special handling by the user and should be reliable and easily connected by the user to form a positive highly reliable mechanical, electrical, and fluid interconnect with the printer.

These ink containment systems should be capable of providing ink at high flow rates to a printhead thereby allowing high throughput printing. This ink supply system should be cost effective to allow relatively low cost per page printing. In addition, the ink supply should be capable of providing ink at high flow rates in a reliable manner to the printhead.

Finally, electrical interconnection between the ink container and printer should be reliable without requiring relatively large contact force. The use of relatively large contact force tends to improve the reliability of the electrical interconnect. Large contact force interconnects tend to require increased latch and insertion forces which tend to result in increased costs due to higher force latch springs and larger latching surfaces. Therefore, the electrical interconnect should be capable of providing high reliability and requiring relatively low interconnect forces.

SUMMARY OF THE INVENTION

The present invention is a replaceable ink container for providing ink to an off-axis printing system. The printing system responsive to electrical signals from the replaceable ink container for controlling printer parameters. The ink container has a leading edge and a trailing edge relative to a direction of insertion of the ink container into the printing system. The replaceable ink container includes a fluid outlet disposed toward the leading edge. The fluid outlet is configured for fluid connection to a hollow needle associated with the printing system. The hollow needle extends in a direction opposite the insertion direction. Included in the ink container is a plurality of electrical contacts disposed on the ink container. The plurality of electrical contacts are configured for engagement with complementary electrical contacts associated with the printing system. Also included in the ink container is a guide member extending from the ink container along the insertion direction. The guide member is configured for engaging a tapered guide member receiving slot associated with the printing system. This engaging repositions the complementary electrical contacts relative to the hollow needle to ensure proper alignment of complementary electrical contacts with the plurality of electrical contacts during insertion of the ink container into the printing system.

DETAILED DESCRIPTION OF THE PREFERRED EMBODIMENT

Figure 1:
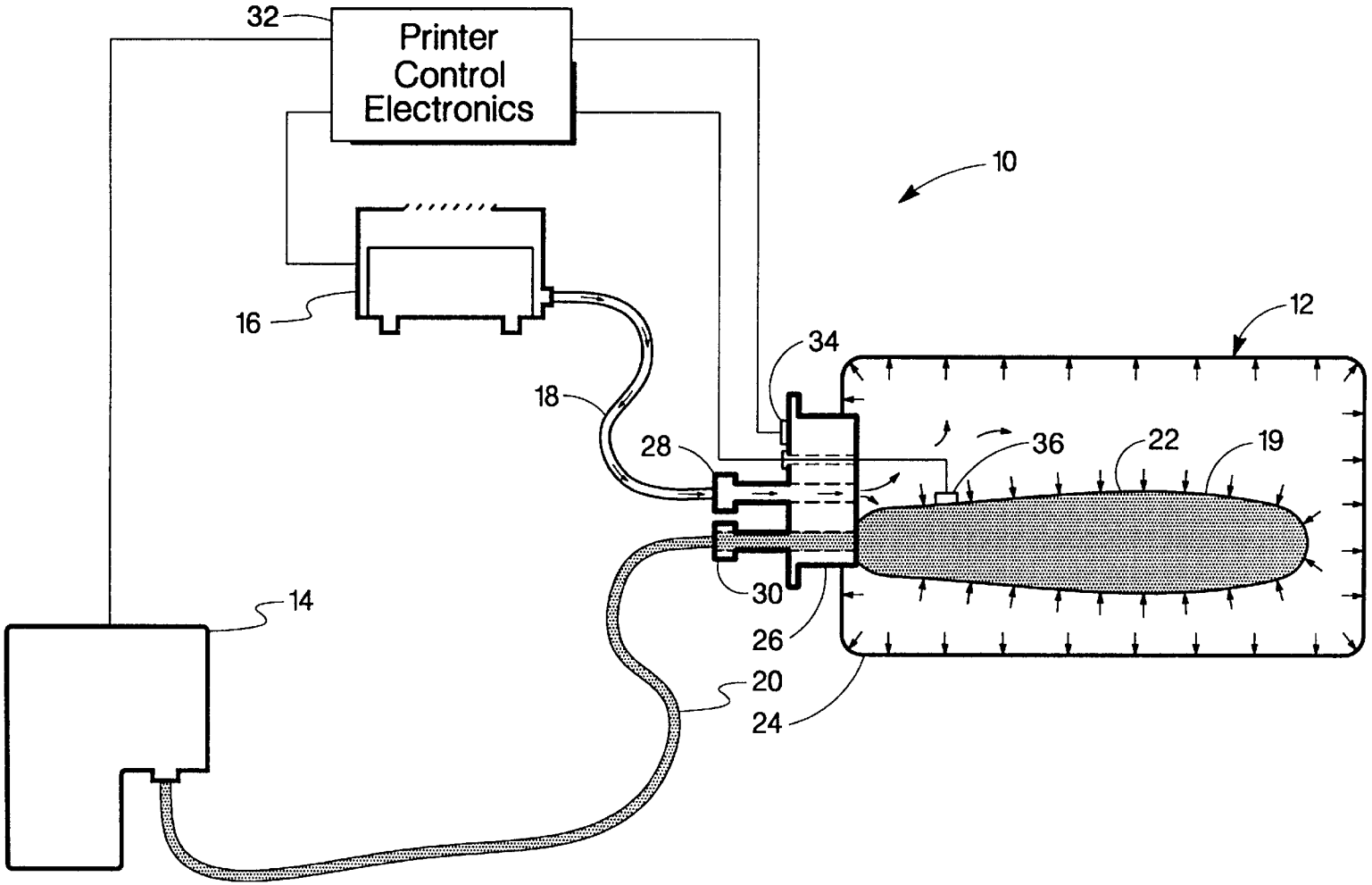
FIG. 1 depicts a schematic representation of a printing system that includes an ink container of the present invention.

FIG. 1 depicts a schematic representation of a printing system 10 which includes the ink container 12 of the present invention. Also included in the printing device 10 is a printhead 14 and a source of pressurized gas such as a pump 16. The pump 16 is connected by a conduit 18 for providing a pressurized gas such as air to the ink container 12. A marking fluid 19 such as ink is provided by the ink container 12 to the printhead 14 by a conduit 20. This marking fluid is ejected from the printhead 14 to accomplish printing.

The ink container 12 which is the subject of the present invention includes a fluid reservoir 22 for containing ink 19, an outer shell 24, and a chassis 26. In the preferred embodiment the chassis 26 includes an air inlet 28 configured for connection to conduit 18 for pressurizing the outer shell 24 with air. A fluid outlet 30 is also included in the chassis 26. The fluid outlet 30 is configured for connection to the conduit 20 for providing a fluid connection between the fluid reservoir 22 and fluid conduit 20.

In the preferred embodiment the fluid reservoir 22 is formed from a flexible material such that pressurization of the outer shell produces a pressurized flow of ink from the fluid reservoir 22 through the conduit 20 to the printhead 14. The use of a pressurized source of ink in the fluid reservoir 22 allows for a relatively high fluid flow rates from the fluid reservoir 22 to the printhead 14. The use of high flow rates or high rates of ink delivery to the printhead make it possible for high throughput printing by the printing system 10.

The ink container 12 also includes a plurality of electrical contacts, as will be discussed in more detail with respect to FIG. 3. The electrical contacts provide electrical connection between the ink container 12 and printer control electronics 32. The printhead control electronics 32 controls various printing system 10 functions such as, but not limited to, printhead 14 activation to dispense ink and activation of pump 16 to pressurize the ink container 12. In one preferred embodiment the ink container 12 includes an information storage device 34 and an ink level sensing device 36. The information storage device 34 provides information to the printer control electronics 32 for controlling printer 10 parameters such as ink container 12 volume as well as ink characteristics, to name a few. The ink level sensing device 36 provides information relating to current ink volume in the ink container 12 to the printer control electronics 32.

The present invention is a method and apparatus for forming a reliable electrical interconnect between the ink container 12 and the printer control electronics 32. The technique of the present invention provides alignment of the electrical contacts on each of the ink container 12 and the ink container receiving station as will be discussed in more detail with respect to FIGS. 11A, 11B, 12A and 12B. In addition, the technique of the present invention ensures that a reliable low resistance electrical connection is formed between proper electrical contacts on each of the ink container 12 and the ink container receiving station once the ink container is properly inserted into the ink container receiving station. Before discussing the details of the present invention it will be helpful to fist discuss the overall printing system 10.

Figure 2:
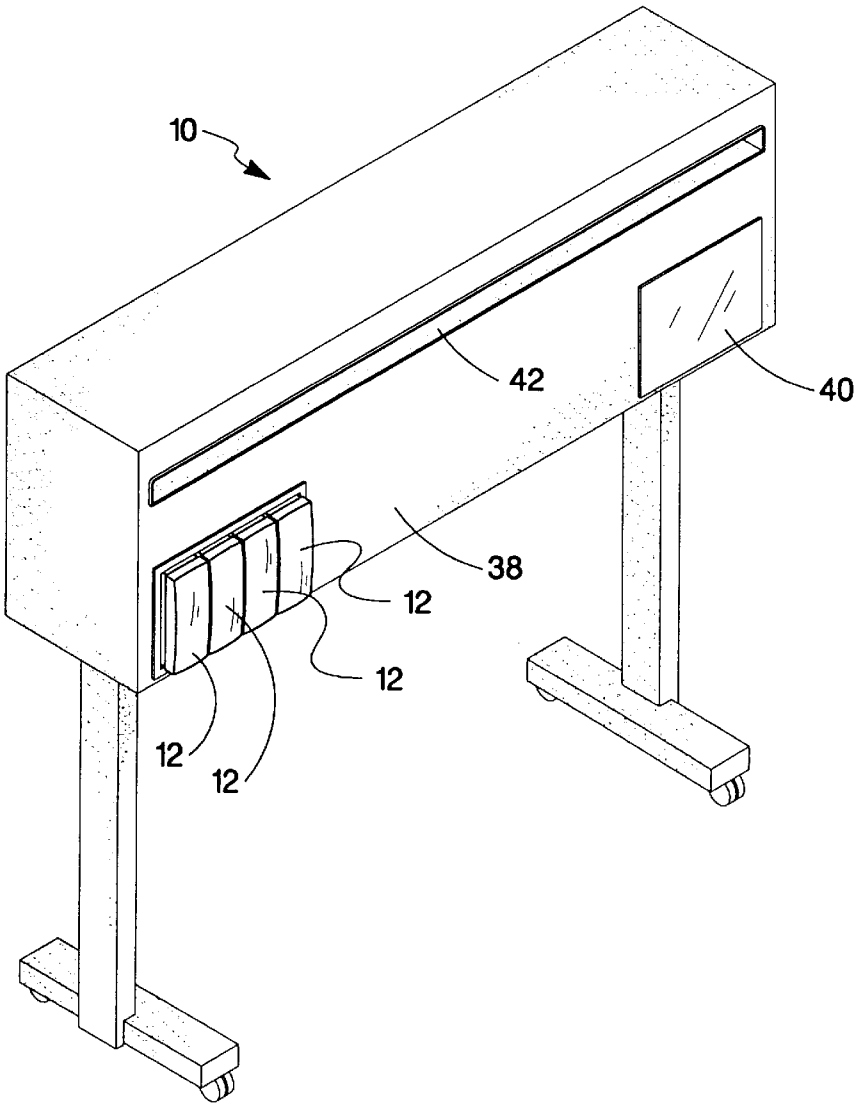
FIG. 2 depicts a perspective view of a representation of the printing system of FIG. 1.

FIG. 2 depicts one embodiment of the printing system 10 shown in perspective. The printing system 10 includes a printing chassis 38 containing one or more ink containers 12 of the present invention. The embodiment shown in FIG. 2 is shown having four similar ink containers 12. In this embodiment, each ink container contains a different ink color. Therefore, four color printing is accomplished by providing cyan, yellow, magenta and black ink from the four ink containers 12 to one or more printheads 14. Also included in the printer chassis 38 is a control panel 40 for controlling operation of the printer 10 and a media slot 42 from which print media such as paper is ejected.

As ink 19 in each ink container 12 is exhausted the ink container 12 is replaced with a new ink container 12 containing a new supply of ink. In addition, the ink container 12 may be removed from the printer chassis 38 for reasons other than an out of ink condition such as changing inks for an application requiring different ink properties or for use on different media. It is important that the ink container 12 be not only accessible within the printing system 10 but also easily replaceable. It is also important that the replacement ink container 12 form reliable electrical connection with corresponding electrical contacts associated with the printer chassis 38 as well as properly form necessary interconnects such as fluid interconnect, air interconnect and mechanical interconnect so that the printing system 11 performs reliably. The present invention is directed to a method and apparatus for reliably engaging the ink container 12 into the printer chassis 38 to insure proper electrical interconnection is formed.

It is important that ink spillage and spattering be minimized to provide reliable interconnection between the ink container 12 and printer 10. Ink spillage is objectionable not only for the operator of the printer who must handle the spattered ink container 12 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

Figure 3:
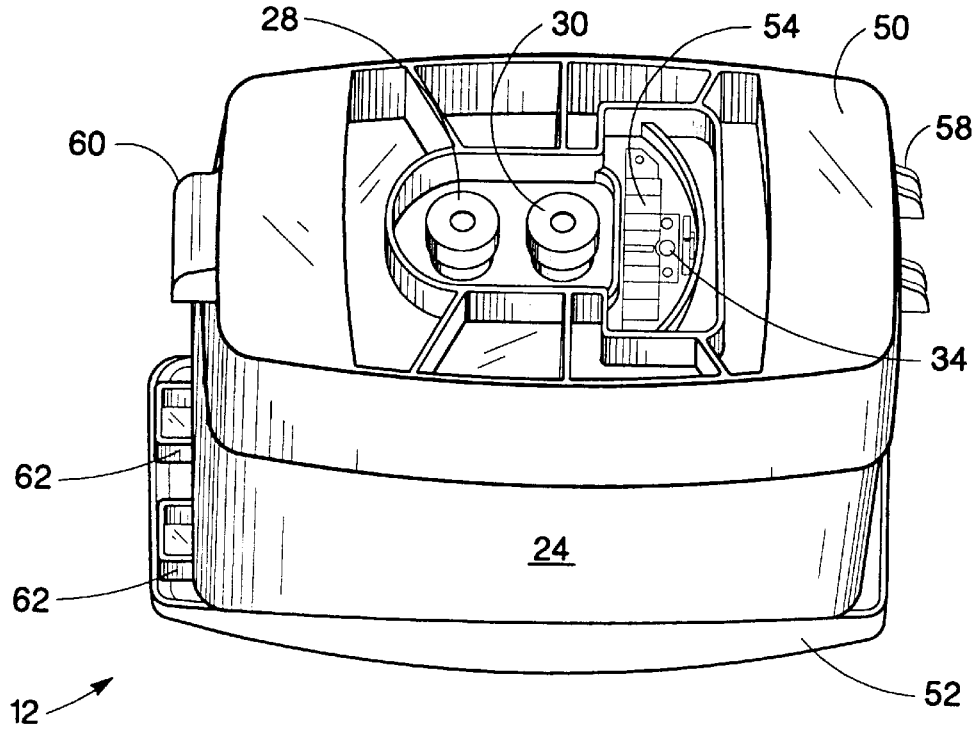
FIG. 3 depicts a perspective view of a leading edge portion of the ink container of the present invention.
Figure 4:
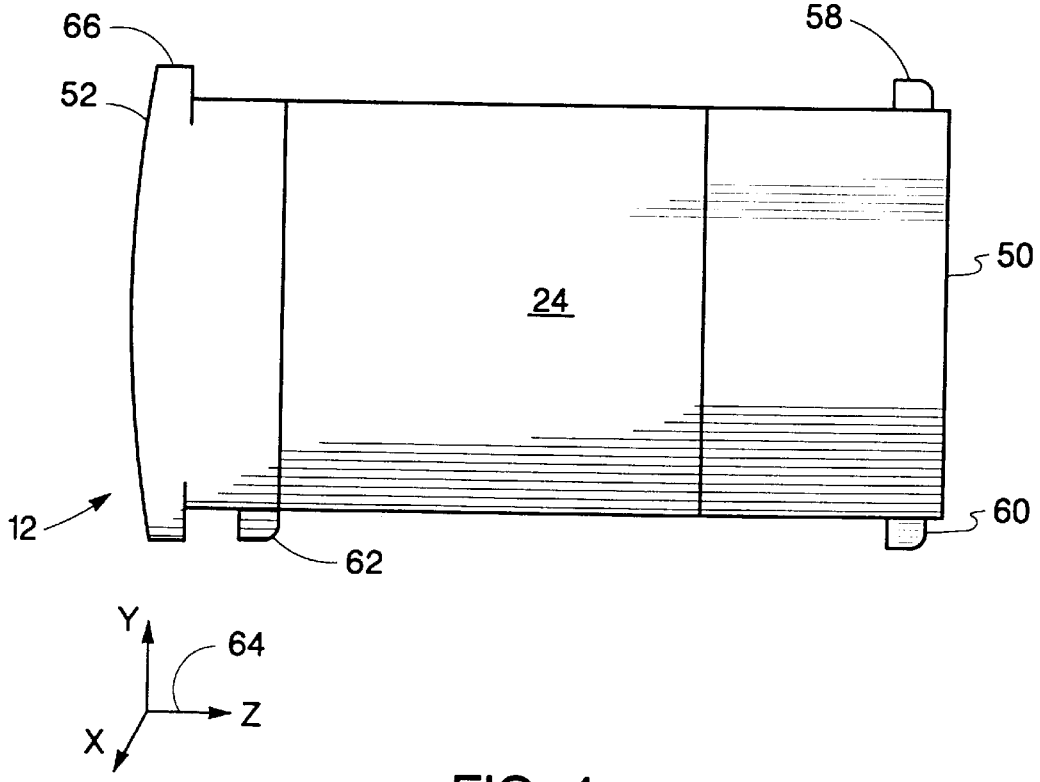
FIG. 4 depicts a side plan view of the ink container of the present invention.

FIGS. 3 and 4 depict the ink container 12 of the present invention. The ink container 12 includes a housing or outer shell 24 which contains the fluid reservoir 22 shown in FIG. 1 for containing ink 19. The outer shell 24 has a leading edge 50 and trailing edge 52 relative to a direction of insertion for the ink container 12 into the printer chassis 38. The leading edge 50 includes the air inlet 28 and the fluid outlet 30 which are configured for connection to the air pump 16 and the printhead 14, respectively, once the ink container 12 is properly inserted into the printer chassis 38. The air inlet 28 and fluid outlet 30 will be discussed in more detail with respect to FIG. 8.

A plurality of electrical contacts 54 are disposed on the leading edge 50 for providing electrical connection between the ink container 12 and printer control electronics 32. In one preferred embodiment the plurality of electrical contacts 54 include a first plurality of electrical interconnects that are electrically interconnected to the information storage device 34 and a second plurality of electrical interconnects which are electrically interconnected to the ink volume sensor 36 shown in FIG. 1. In the preferred embodiment the information storage device 34 is a semiconductor memory and the ink volume sensing device 36 is an inductive sensing device. The electrical contacts 54 will be discussed in more detail with respect to FIG. 5.

The ink container 12 includes one or more keying and guiding features 58 and 60 disposed toward the leading edge 50 of the ink container 12. The keying and guiding features 58 and 60 work in conjunction with corresponding keying and guiding features on the printer chassis 38 to assist in aligning and guiding the ink container 12 during insertion of the ink container 12 into the printer chassis 38. The keying and aligning features 58 and 60 in addition to providing a guiding function also provide a keying function to insure only ink containers 12 having proper ink parameters such as proper color and ink type are inserted into a given slot in printer chassis 38. Keying and guiding features are discussed in more detail in co-pending patent application Ser. No. 08/566,521 filed Dec. 4, 1995 entitled "Keying System for Ink Supply Containers" assigned to the assignee of the present invention and incorporated herein by reference.

A latch feature 62 is provided toward the trailing edge 52 of the ink container 12. The latch feature 62 works in conjunction with corresponding latching features on the printer portion to secure the ink container 12 within the printer chassis 38 such that proper interconnects such as pressurized air, fluidic and electrical are accomplished in a reliable manner. The latching feature 62 is a molded tang which extends downwardly relative to a gravitational frame of reference. The ink container 12 shown in FIG. 4 is positioned for insertion into a printer chassis 38 along the Z-axis of coordinate system 64. In this orientation gravitational forces act on the ink container 12 along the Y-axis.

Figure 5:
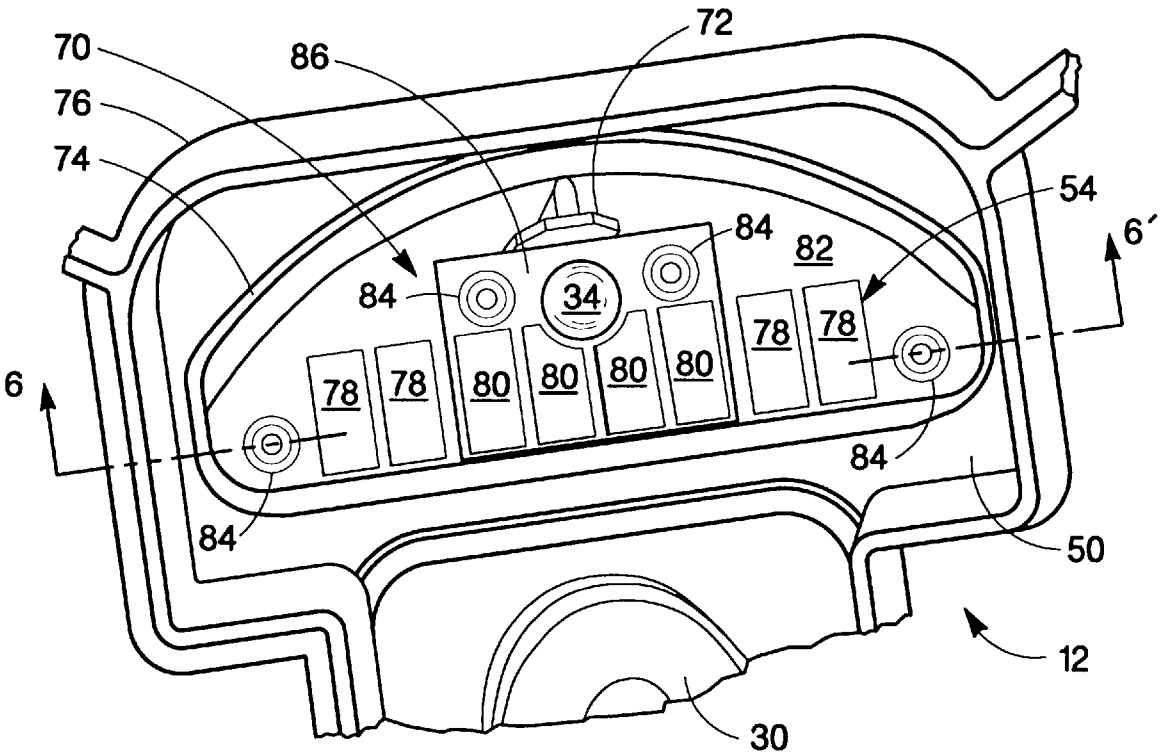
FIG. 5 depicts a top plan view, partially broken away, of the electrical connection portion of the ink container of FIG. 3.

FIG. 5 depicts an electrical interconnect portion 70 which is the subject of the present invention. The electrical interconnect portion 70 includes electrical contacts 54 and upstanding guide member 72, and inner wall member 74, and an outer wall member 76. In the preferred embodiment, the plurality of electrical contacts 54 include electrical contacts 78 which are electrically connected to the fluid sensing device 36 shown in FIG. I and electrical contacts 80 which are electrically connected to the information storage device 34. In the preferred embodiment, the electrical contacts 78 are defined in a flexible circuit 82 which is mounted to the ink container 12 by fastener 84. A circuit 86 on which contacts 80 and information storage device 34 are disposed provides electrical connection between the information storage device 34 and contacts 80. The circuit 86 is attached to the ink container 12 by fastener 84.

The inner upstanding wall 74 and the outer upstanding wall 76 help protect the electrical circuit 86, information storage device 34, and contacts 78 and 80 from mechanical damage. In addition, the upstanding walls 74 and 76 help minimize inadvertent finger contact with the electrical contact 78 and 80. Finger contact with the electrical contact 78 and 80 can result in the contamination of these electrical contacts which can result in reliability problems with the electrical connection between the ink container 12 and the printing system 10. Finally, inadvertent contact with the electrical contact 78 and 80 can result in an electrostatic discharge (ESD) which can result in reliability problems with the information storage device 34. If the information storage device is particularly sensitive to electrostatic discharge such a discharge may result in catastrophic failure of the information storage device 34.

Figure 6:
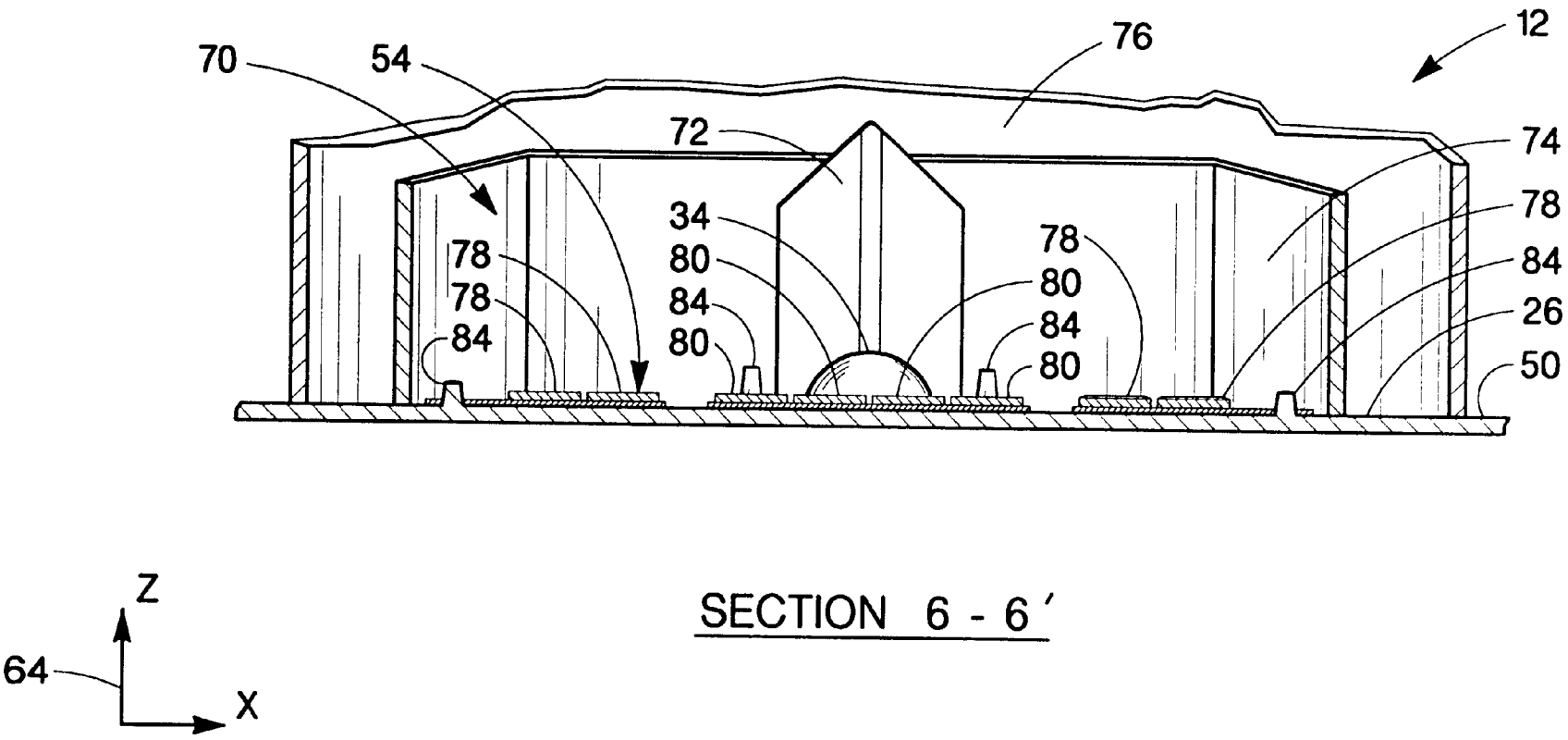
FIG. 6 depicts a side plan view of the electrical connection portion of the ink container taken across lines 6–6' shown in FIG. 5

FIG. 6 shows a sectional view of the electrical interconnect 70 shown in FIG. 5. It can be seen from FIG. 6 that the upstanding member 72 extends outward from a leading edge portion 50 of the ink container 12 along a Z-axis in coordinate system 64. The upstanding guide member 72 in the preferred embodiment is tapered from a leading edge toward the trailing edge. The upstanding guide member as will be discussed with respect to FIGS. 11A, 11B, 12A, and 12B provides a critical guiding function to insure proper electrical connection is accomplished during the insertion of ink container 12 into the printer chassis 38.

In one preferred embodiment the upstanding guide member 72 is formed integrally with an ink container chassis 26. In this preferred embodiment the ink container chassis 26 defines the air inlet 28 as well as the fluid outlet 30.

Figure 7:
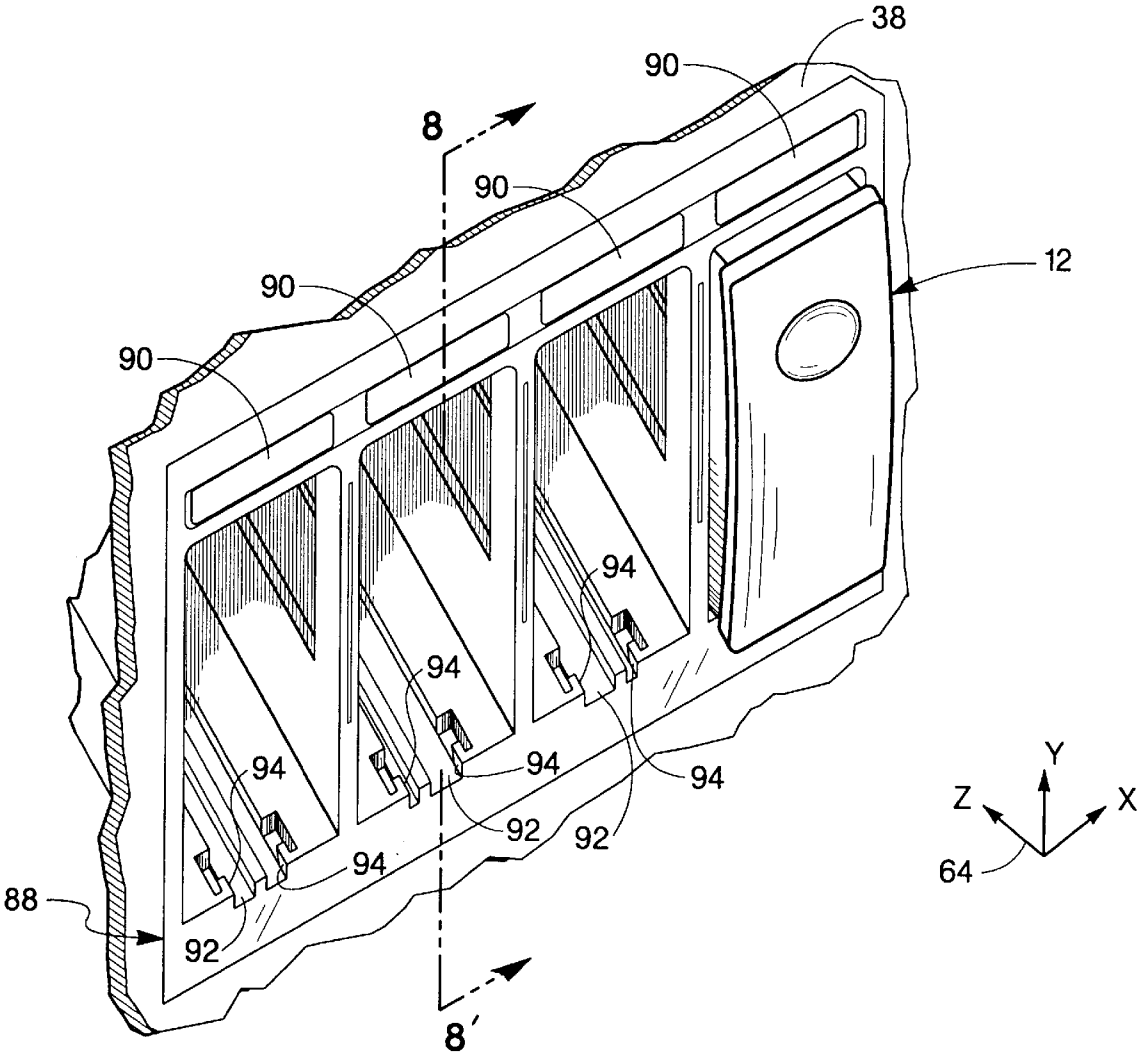
FIG. 7 depicts a perspective view of an ink container receiving station shown partially broken away with an ink container of the present invention installed.

FIG. 7 depicts an ink container 12 of the present of the present invention shown secured within an ink container receiving station 88 within the printer chassis 38. Because ink container 12 is similar except for keying and guiding features 58 and 60 and corresponding ink properties contained within the respected fluid reservoir, the same reference numbering will be used for each ink container 12. An ink container indicia 90 may be positioned proximate each slot in the ink container receiving station 88. The ink container indicia 90 may be a color swatch or text indicating ink color to assist the user in color matching for inserting the ink container 12 in the proper slot within the ink container receiving station 88. As discussed previously the keying and guiding features 58 and 60 shown in FIGS. 3 and 4 prevent ink containers from being installed in the wrong slot. Installation of an ink container in the wrong slot can result in improper color mixing or the mixing of inks of different ink types each of which can result in poor print quality.

Each receiving slot within the ink container receiving station includes a corresponding keying and guiding slot 92 and a recessed latching portion 94. The guiding slot 92 cooperates with the keying and guiding features 58 and 60 to guide the ink container 12 into the ink container receiving station 88. The keying and guiding slot 92 associated with the corresponding keying and guiding feature 60 is shown in FIG. 5 and the keying and guiding slot associated with the corresponding keying and guiding feature 58 on the ink container 12 is not shown. The latching features 94 are configured for engaging the corresponding latching features 62 on the ink container 12.

Figure 8:
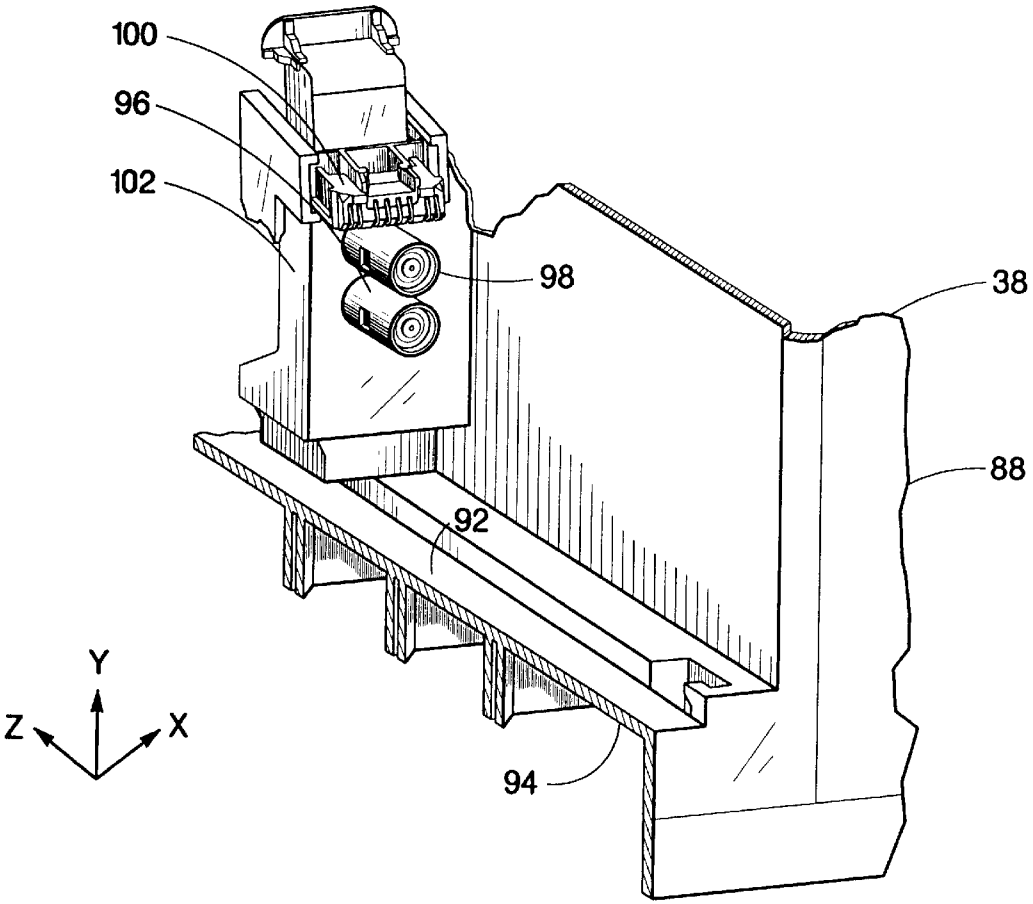
FIG. 8 depicts a cross-section taken across line 8–8' of the ink container receiving station of FIG. 7 shown partially broken away.

FIG. 8 shows a cross-section of a single ink container receiving slot within the ink container receiving station 88. The ink container receiving slot includes interconnect portions for interconnecting with the ink container 12. In the preferred embodiment these interconnect portions include a fluid inlet 98, and air outlet 96 and an electrical interconnect portion 100. Each of the interconnects 96, 98, and 100 are positioned on a floating interconnect portion 102 which is biased along the Z-axis toward the installed ink container 12.

The fluid inlet 98 and the air outlet 96 associated with the ink container receiving station 88 are configured for connection with the corresponding fluid outlet 30 and air inlet 28, respectively on the ink container 12. The electrical interconnect 100 is configured for engaging the plurality of electrical contact 54 on the ink container 12.

It is the interaction between the keying and guiding features 58 and 60 associated with the ink container 12 and the corresponding keying and guiding feature 92 associated with the ink container receiving station 88 which guide the ink container 12 during the insertion such that proper interconnection are accomplished between the ink container 12 and the printer chassis 38. In addition, sidewalls associated with each slot in the ink container receiving station 88 engage corresponding sidewalls of the outer shell 24 of ink container 12 to assist in guiding and aligning the ink container 12 during insertion into the ink container receiving station 88.

Figure 9:
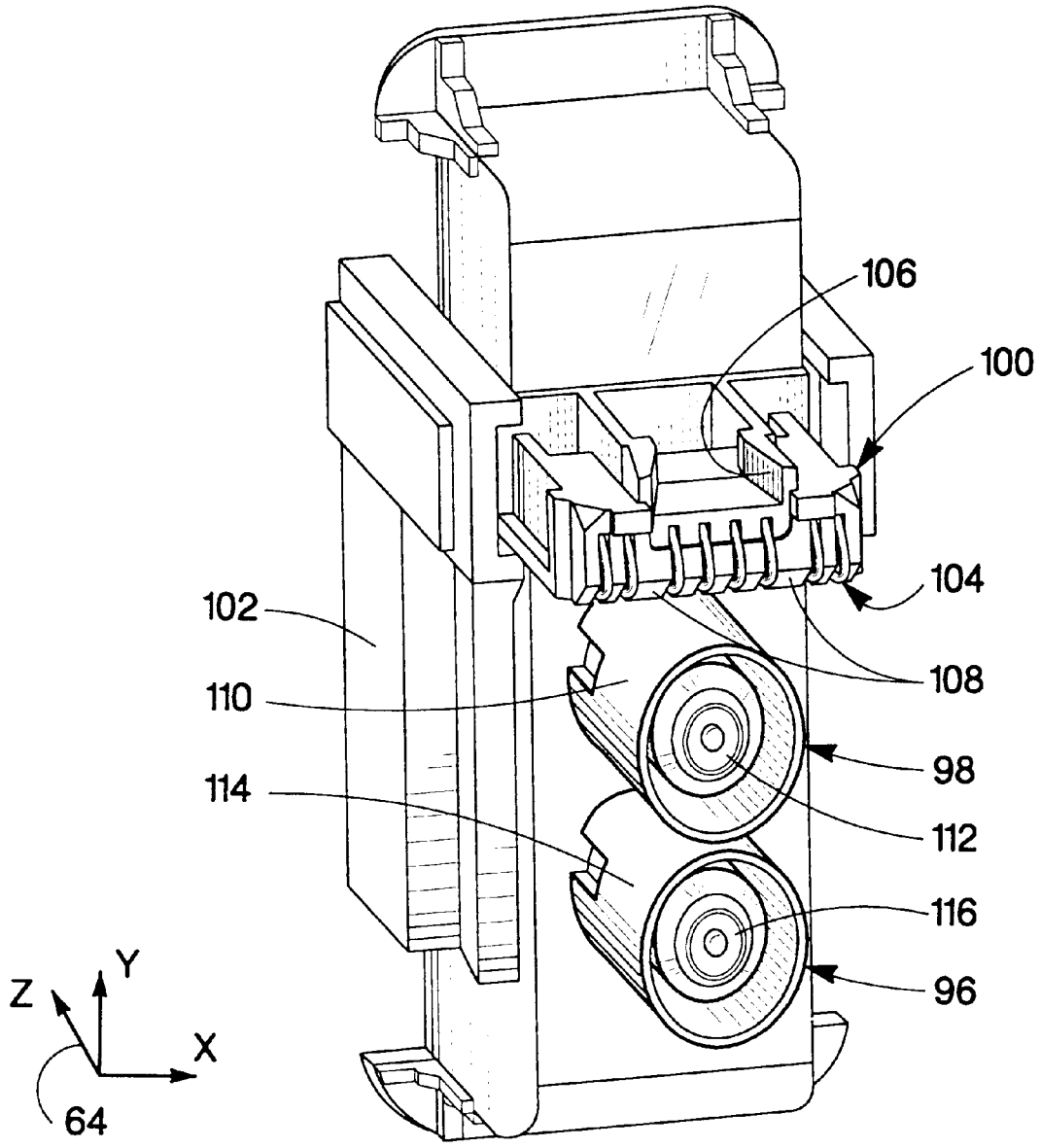
FIG. 9 depicts an electrical, fluid and air connectors shown greatly enlarged of the ink container receiving station shown FIG. 8.

FIG. 9 illustrates further detail of the floating interconnect portion 102 shown in FIG. 8. The floating interconnect portion 102 is spring biased in a direction opposite the direction of insertion of the ink container 12 into the ink container receiving 88. The floating interconnect portion 102 is biased towards mechanical restraints (not shown) which limit the motion of the floating interconnect portion in each of the X, Y, and Z-axis. Therefore, the floating interconnect portion 102 has a limited degree of motion in each of the X, Y, and Z axis of coordinate system 64.

The electrical interconnect portion 100 which is the subject of the present invention is mounted such that the electrical interconnect 100 is free to move in a direction generally orthogonal to the direction of insertion or along the X-axis relative to the floating interconnect portion 102. The electrical interconnect portion 100 is mounted such that mechanical restraints limit the amount of motion of the electrical interconnect 100 along the X-axis.

The electrical interconnect portion 100 includes a plurality of spring biased electrical contacts 104. The electrical contacts 104 engage corresponding electrical contacts 54 associated with the ink container 12 to electrically connect the ink container 12 with the printer control electronics 32 shown in FIG. 1.

The electrical connector 100 further includes a guide slot 106 and a pair of guide members 108. The guide slot together with the pair of guide members 108 cooperate to engage the upstanding guide member 72 and inner wall 74 to properly align the electrical interconnect 100 with the electrical interconnect 70 associated with the ink container 12. Proper alignment of the electrical interconnect 100 associated with the ink container receiving station 88 with the electrical interconnect 70 associated with the ink container involves the proper alignment of the spring biased electrical contacts 104 with corresponding electrical contacts 54 associated with the ink container 12. The electrical interconnect 100 will be discusses in more detail in respect to FIG. 10.

The floating interconnect portion 102 also includes a fluid inlet 98 and air outlet 96. In the preferred embodiment the fluid inlet 98 includes a housing 110 having an upstanding needle and a spring biased sealing portion 112 disposed therein. Similarly, the air outlet 96 includes an upstanding member 114 having an upstanding needle and a spring biased sealing portion 16 disposed therein. With the ink container 12 properly inserted into the ink container receiving station 88 fluid outlet 30 and air inlet 28 are inserted into the housing 110 and housing 114, respectively such that the needle and sealing members 112 and 116, respectively form the proper respective fluid and air interconnects with the ink container 12.

Figure 10:
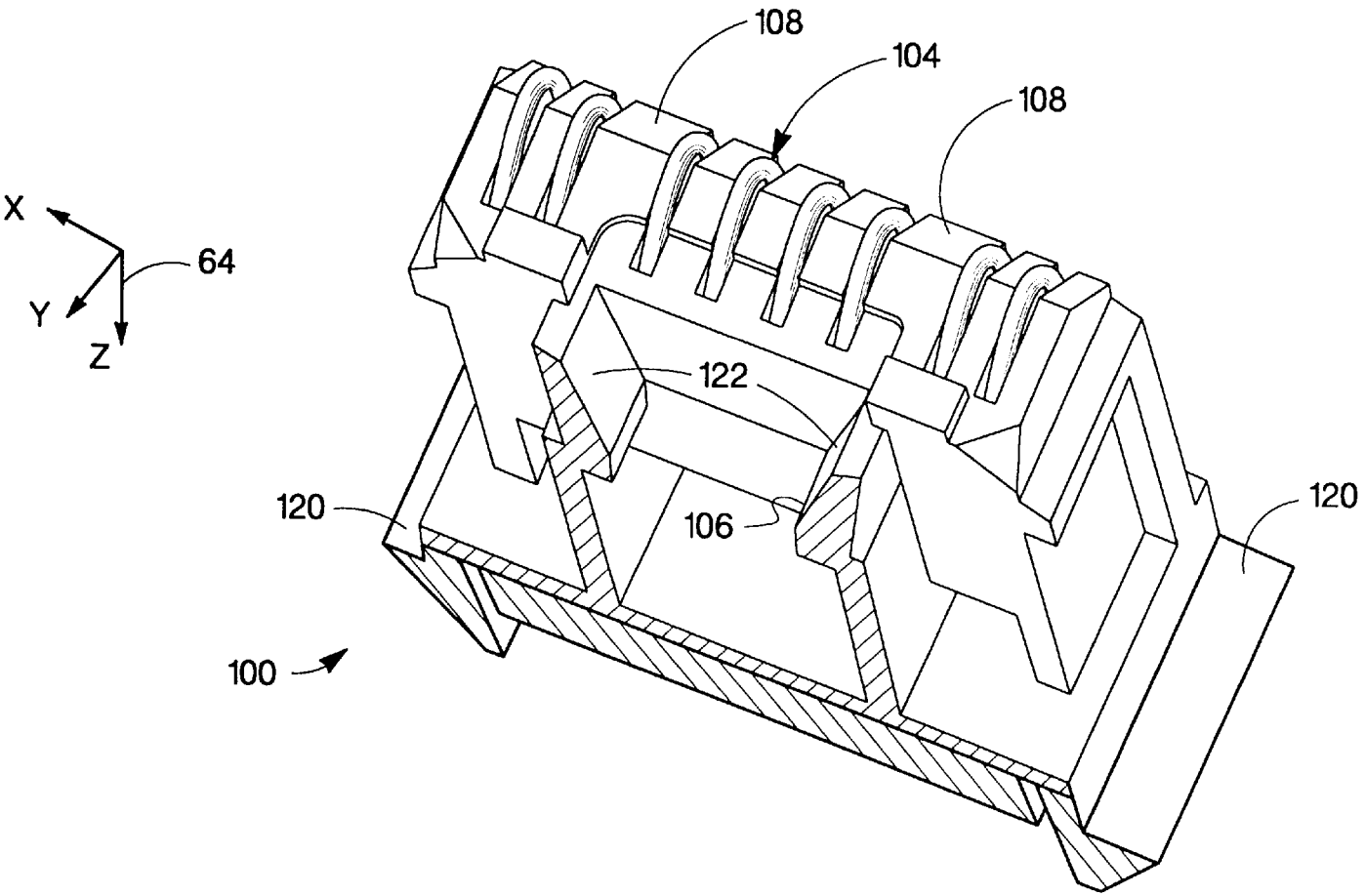
FIG. 10 depicts a perspective view of the electrical connector of FIG. 9 shown greatly enlarged.

FIG. 10 discloses the electrical interconnect 100 of the present invention. The electrical interconnect 100 includes shoulder portions 120 which fit into corresponding slot (not shown) on the floating interconnect portion 102 allowing the electrical interconnect 100 to move freely along the X-axis within a limited range of motion. The guiding slot 106 includes tapered portions 122 which allow the guiding slot 106 to receive the upstanding member 72 associated with the electrical interconnect 70 on ink container 12. It is the upstanding guide member 72 which provides proper alignment along the X-axis for the interconnect 100 such that the spring biased electrical contacts 104 properly engage the corresponding electrical contacts 54 associated with the ink container 12.

Figure 11:
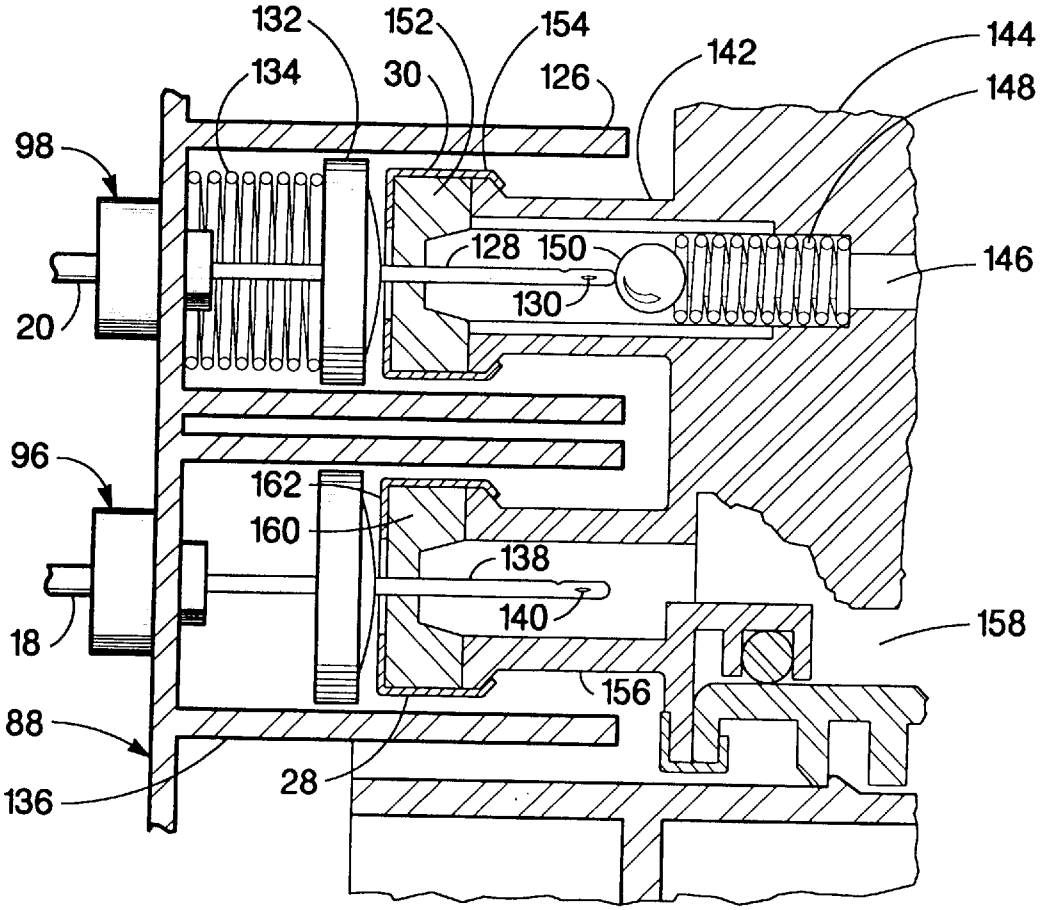
FIG. 11 depicts a cross section of a fluid outlet and an air inlet for the ink container of the present invention shown in engagement with a fluid inlet and air outlet, respectively, associated with the ink container receiving station shown in FIG. 8.

FIG. 11 illustrates further detail of the preferred the fluid outlet 30 and air inlet 28 associated with the ink container 12 and the corresponding fluid inlet 98 and air outlet 96 associated with the ink container receiving station 88.

In this preferred embodiment the fluid inlet 98 associated with the ink container receiving station 88 includes a housing 126 and outwardly extending needle 128 having a closed, blunt upper end, a blind bore (not shown) and a lateral hole 130. The blind bore is fluidly connected to the lateral hole 130. The end of the needle 128 opposite the lateral hole 130 is connected to the fluid conduit 20 for providing ink to the printhead 14 shown in FIG. 1. A sliding collar 132 surrounds the needle 128 and is biased upwardly by spring 134. The sliding collar 132 has a compliant sealing portion with an exposed upper surface and an inner surface in direct contact with the needle 128.

The air outlet 96 on the ink container receiving station 88 is similar to the fluid inlet 98 except does not include the sliding collar 132 and the spring 134. The air outlet 96 on the ink container receiving station 88 includes a housing 136 and an outwardly extending needle 138 having a closed, blunt upper end, a blind bore (not shown) and a lateral hole 140. The blind bore is fluidly connected to the lateral hole 140. The end of the needle 138 opposite the lateral hole 140 is connected to the air conduit 18 for providing pressurized air to the ink container 12 shown in FIG. 1.

In this preferred embodiment, the fluid outlet 30 associated with the ink container 12 includes a hollow cylindrical boss 142 that extends outward from an ink container chassis 144. The end of the boss 142 toward the chassis 144 opens into a conduit 146 which is fluidly connected to the ink reservoir 22 thereby providing fluid to the fluid outlet 30. A spring 148 and sealing ball 150 are positioned within the boss 142 and held in place by a compliant septum 152 and a crimp cover 154. The spring 148 biases the sealing ball 150 against the septum 152 to form a fluid seal.

In the preferred embodiment, the air inlet 28 associated with the ink container 12 is similar to the fluid outlet 30 except that the additional seal formed by the spring 148 and sealing ball 150 are eliminated. The air inlet 28 associated with the ink container 12 includes a hollow cylindrical boss 156 that extends outward from an ink container chassis 144. The end of the boss 156 toward the chassis 144 opens into a conduit 158 which is in communication with a region between the outer shell 24 and an outer portion of the fluid reservoir 22 for pressurizing the fluid reservoir 22. A compliant septum 160 and a crimp cover 162 form a seal.

The insertion of the ink container 12 into the ink container receiving station 88 such that proper interconnection is formed will now be discussed with respect to FIGS. 12A, 12B, 13A, and 13B. As the ink container 12 is initially inserted into the ink container receiving station 88 the keying and guiding features 58 and 60 associated with the ink container must be properly aligned with corresponding keying and guiding features 92 associated with the ink container receiving station 88. Proper alignment of these keying and guiding features ensures that the ink container 12 is inserted in the proper slot within the ink container receiving station 88.

Figures 12A, 12B:
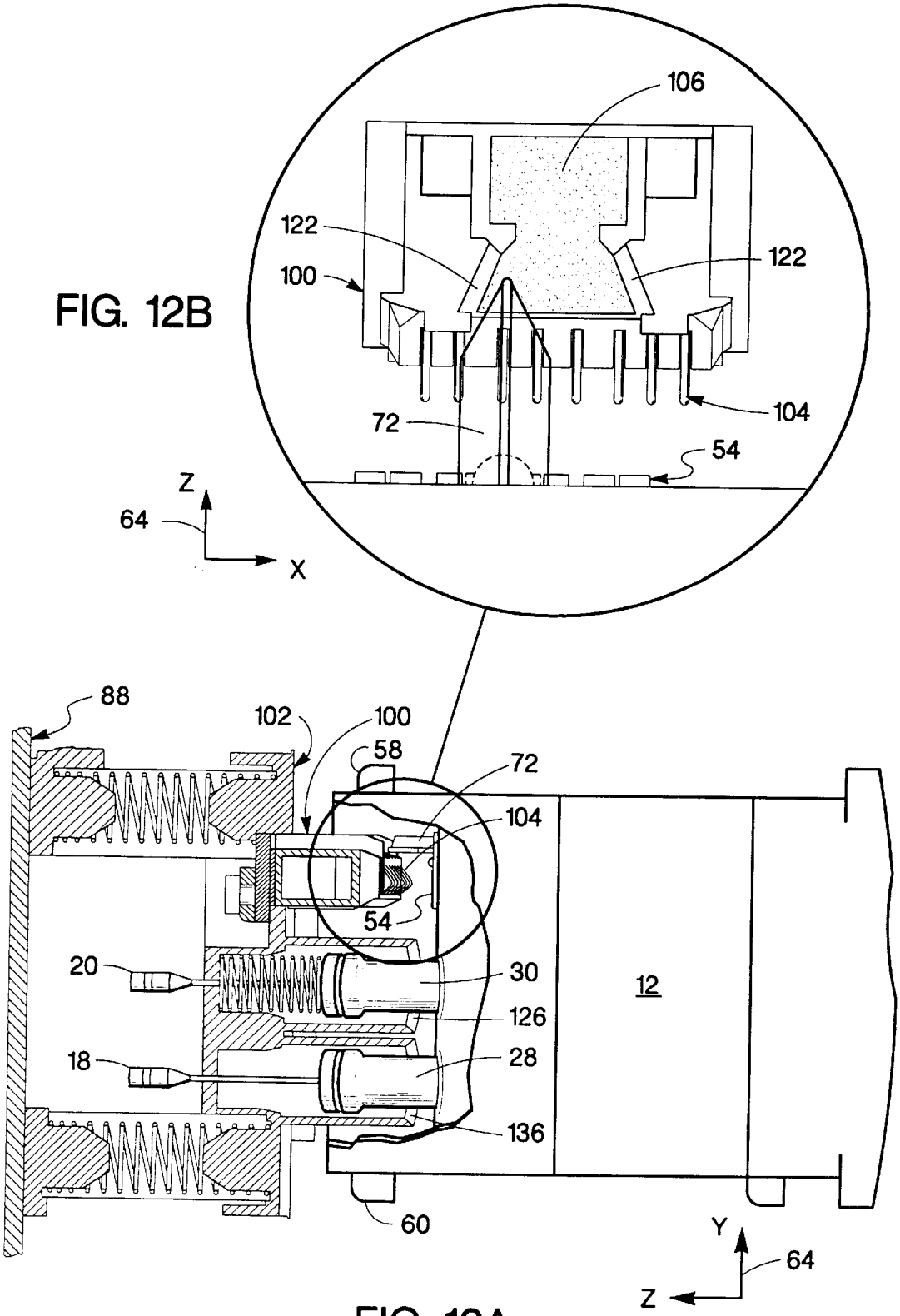
FIGS. 12A and 12B depict a side and top plan views, respectively, shown partially broken away, illustrating partial alignment of the electrical connectors with the ink container of the present invention partially inserted.

As shown in FIGS. 12A and 12B, further insertion of the ink container 12 into the ink container receiving station 88 results in the outwardly extending fluid outlet 30 and air inlet 28 engaging the corresponding housing associated with the fluid inlet and air outlet 126 and 136, respectively on the ink container receiving station 88. As the fluid and air interconnects 30 and 28 engage the housing members 126 and 136, respectively the floating interconnect 102 is aligned along the X and Y axis with the ink container 12. In the preferred embodiment, the electrical interconnect 70 fluid outlet 30, and air inlet 28 are all formed integrally on the same chassis portion of ink container 12. Therefore, alignment of the floating interconnect portion 102 with the fluid outlet 30 and air inlet 28 provides a course alignment of the electrical interconnect 100 associated with the ink container receiving station 88 with the electrical interconnect 70 associated with the ink container 12.

It can be seen from FIG. 12B the electrical contacts 54 associated with the ink container are not in proper alignment with the electrical spring contacts 104 associated with the ink container receiving station. However, the course alignment along the X and Y-axis provided by the fluid and air interconnects 30 and 28 with the corresponding fluid and air housing members 126 and 136, respectively ensures that the guide member 72 is at least roughly aligned with the guide slot 106. As the ink container 12 is further inserted into the ink container receiving station 88 the tapered portion on each of the upstanding guide member 72 and tapered portions 122 on the guide slot 106 exert a force on the electrical interconnect 100 to urge the electrical interconnect along the X-axis relative to the interconnect portion 102 to provide a centering of the upstanding guide member 72 within the receiving slot 106.

Figures 13A, 13B:
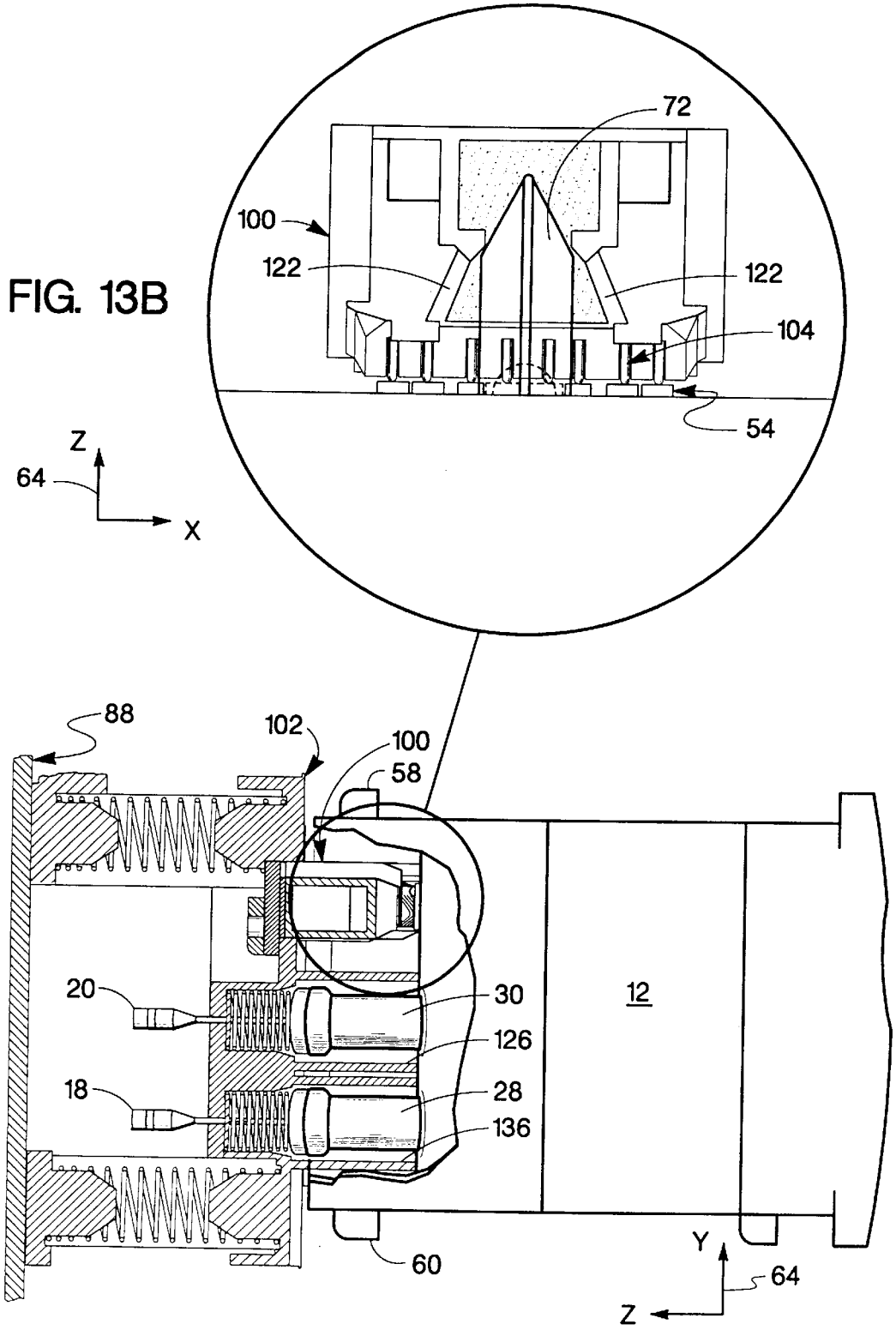
FIGS. 13A and 13B depict a side and top plan views, respectively, shown partially broken away, illustrating complete alignment of the electrical connectors with the ink container of the present invention fully inserted.

FIG. 13A shows the ink container 12 fully inserted into the ink container receiving station 88. In this fully inserted position proper fluid and air interconnects are formed between the ink container 12 and the ink container receiving station 88. In addition, as shown in FIG. 13B the electrical interconnect 100 is urged into a centered position by the engagement of the upstanding guide member 72 and guide slot 106. In this centered position the electrical contacts 54 associated with the ink container 12 engage the proper spring biased electrical contacts 104 associated with the ink container receiving station 88. Because the spring biased electrical contacts 104 are biased against the electrical contacts 54 a proper low resistance electrical contact is formed.

The present invention makes use of an electrical interconnect system which allows for misalignment between both the ink container 12 and receiving station 88. Because the present invention makes use of both a course alignment system for aligning the fluid and air interconnects and a separate fine alignment system for aligning the electrical interconnects a large amount of misalignment between the ink container 12 and the receiving station can be tolerated.

An important feature which allows for this misalignment between the ink container and printer portion is the use of an electrical interconnect on the printer portion that is movable relative to the fluid and air interconnects. The electrical interconnect makes use of an alignment member for aligning the electrical interconnect separately from the fluid and air interconnects. By using an alignment member associated with each of the electrical interconnects which is a separate from the fluid interconnects proper electrical alignment is ensured. The alignment system of the present invention makes it possible to use ink containers 12 which are formed using inexpensive molding processes to be used while ensuring an accurate and highly reliable electrical interconnect as well as fluid interconnects are formed.

What is claimed is:

1. A replaceable ink container for providing ink to an off-axis printing system, the printing system responsive to electrical signals from the replaceable ink container for controlling printer parameters, the replaceable ink container comprising:

a housing having a leading edge and a trailing edge relative to a direction of insertion of the ink container into the printing system;

a fluid outlet disposed toward the leading edge, the fluid outlet configured for fluid connection to a hollow needle associated with the printing system, the hollow needle extending in a direction opposite the insertion direction;

a plurality of electrical contacts disposed on the housing, the plurality of electrical contacts configured for engagement with complementary electrical contacts associated with the printing system; and a guide member positioned on the leading edge of the housing proximate the plurality of electrical contacts, the guide member extending from the ink container along the insertion direction, the guide member configured for engaging a tapered guide member receiving slot associated with the printing system for repositioning the complementary electrical contacts relative to the hollow needle to ensure proper alignment of complementary electrical contacts with the plurality of electrical contacts during insertion of the ink container into the printing system.

2. The replaceable ink container of claim 1 wherein the fluid outlet includes a septum and a ball valve and wherein with the replaceable ink container properly inserted into the printing system the hollow needle extends through the septum and displaces the ball valve to allow ink to pass between the ink container and the printing system.

3. The replaceable ink container of claim 2 wherein the plurality of electrical contacts, the fluid outlet and the guide member are each disposed on a chassis portion of the ink container.

4. The replaceable ink container of claim 3 wherein the guide member is formed integrally with the chassis portion.

5. The replaceable ink container of claim 1 further including an air inlet, the air inlet configured for connection to a complementary air outlet associated with the printing system for pressurizing the replaceable ink container for increasing fluid flow rates through the fluid outlet.

6. The replaceable ink container of claim 5 wherein the fluid outlet, the air inlet, and guide member are each formed in a chassis portion of the replaceable ink container.

7. The replaceable ink container of claim 1 wherein the tapered guide member receiving slot and the complementary electrical contacts associated with the printing system are each part of an electrical connector, the electrical connector is positioned in the printing system and is movable relative to the fluid outlet.

8. A replaceable ink container for use in an off-axis printing system, the printing system responsive to electrical signals from the replaceable ink container for controlling printer parameters, the replaceable ink container comprising:

a housing having a leading edge and a trailing edge relative to a direction of insertion of the ink container into the printing system;

a fluid outlet disposed toward the leading edge, the fluid outlet configured for connection to a corresponding fluid inlet associated with the printing system;

a plurality of electrical contacts electrically connected with a memory element for storing information for controlling printing system parameters, the plurality of electrical contacts being disposed on the leading edge of the housing for engagement with movable complimentary electrical contacts associated with the printing system, such that upon proper insertion of the ink container into the printing system, the movable complimentary electrical contacts are repositioned to ensure proper alignment of complementary electrical contacts of the printing system with the plurality of electrical contacts of the ink container, and wherein upon complete insertion of the ink container into the printing system, the plurality of electrical contacts are disposed and arranged above the fluid outlet, relative to a gravitational frame of reference, to prevent spilled ink at the fluid outlet from contaminating the plurality of electrical contacts.

9. The ink container of claim 8 wherein the insertion direction is generally orthogonal to the gravitational frame of reference.

10. The ink container of claim 8 further including an air inlet disposed on the leading edge, the air inlet configured for connection to a complementary air outlet associated with the printing system.

11. An off-axis printing system for forming images on media, the off-axis printing system comprising:

a printhead for selectively depositing ink droplets onto media;

a receiving station for providing ink to the printhead, the receiving station configured to receive a replaceable ink container having a fluid outlet and a plurality of electrical contacts, the receiving station defining an ink container receiving slot having a fluid inlet configured for fluid connection with the fluid outlet of the ink container, and complementary electrical contacts configured for engagement with the plurality of electrical contacts of the ink container, at least one of the fluid inlet and complementary electrical contacts being independently movable relative to the receiving station, such that upon insertion of the ink container into the receiving slot, the at least one independently movable fluid inlet and complementary electrical contacts is repositioned to ensure proper alignment of the complementary electrical contacts with the plurality of electrical contacts and proper alignment of the fluid inlet with the fluid outlet.

12. The off-axis printing system of claim 11 wherein the complementary electrical contacts are independently repositionable relative to the receiving station and the fluid inlet.

13. The off-axis printing system of claim 12 wherein the receiving station includes a guide member element for receiving a complementary guide member element of the ink container upon insertion of the ink container into the receiving slot for repositioning the complementary electrical contacts relative to the receiving station and the fluid inlet.

14. A replaceable ink container for ensuring that proper fluidic and electrical interconnects are formed between the ink container and an off-axis printing system, the printing system responsive to electrical signals from the replaceable ink container for controlling printer parameters, the replaceable ink container comprising:

a housing having a leading edge and a trailing edge relative to a direction of insertion of the ink container into the printing system;

a fluid outlet disposed on the housing toward the leading edge, the fluid outlet configured for fluid connection to a fluid inlet associated with the printing system to form a fluidic interconnect;

a plurality of electrical contacts disposed on the housing toward the leading edge, the plurality of electrical contacts configured for engagement with complementary electrical contacts associated with the printing system to form an electrical interconnect, wherein upon initial insertion of the ink container into the printing system, the fluid outlet engages the fluid inlet forming the fluidic interconnect and providing a coarse alignment of the plurality of electrical contacts with the complementary electrical contacts, and wherein upon further insertion of the ink container into the printing system, the plurality of electrical contacts engage the complementary electrical contacts providing the electrical interconnect.

15. The replaceable ink container of claim 14 wherein upon engagement of the plurality of electrical contacts with the complementary electrical contacts, the complementary electrical contacts are repositioned independent of and relative to the fluid inlet to ensure proper fine alignment of complementary electrical contacts with the plurality of electrical contacts.

16. The replaceable ink container of claim 15, and further including:

a guide member positioned on the leading edge of the housing proximate the plurality of electrical contacts, the guide member extending from the ink container along the insertion direction, the guide member configured for engaging a guide member receiving element of the printing system for repositioning the complementary electrical contacts to ensure proper fine alignment of complementary electrical contacts with the plurality of electrical contacts.

* * * * *